US009573412B2

(12) United States Patent
Kim

(10) Patent No.: US 9,573,412 B2
(45) Date of Patent: Feb. 21, 2017

(54) METHOD OF MANUFACTURING ORNAMENT INLAID WITH MOTHER-OF-PEARL

(71) Applicant: Kyung Ja Kim, Irvine, CA (US)

(72) Inventor: Kyung Ja Kim, Irvine, CA (US)

( * ) Notice: Subject to any disclaimer, the term of this patent is extended or adjusted under 35 U.S.C. 154(b) by 22 days.

(21) Appl. No.: 14/746,123

(22) Filed: Jun. 22, 2015

(65) Prior Publication Data

US 2016/0368309 A1 Dec. 22, 2016

(51) Int. Cl.

| | |
|---|---|
| ***B44C 1/28*** | (2006.01) |
| ***B05D 5/04*** | (2006.01) |
| ***B44C 5/06*** | (2006.01) |

(52) U.S. Cl.

CPC . *B44C 1/28* (2013.01); *B05D 5/04* (2013.01); *B44C 5/06* (2013.01)

(58) Field of Classification Search

CPC ..... B44C 1/28

See application file for complete search history.

(56) References Cited

FOREIGN PATENT DOCUMENTS

KR 10-2004-0023144 3/2004

*Primary Examiner* — Daniel Lee

(74) *Attorney, Agent, or Firm* — Revolution IP, PLLC

(57) ABSTRACT

Provided is a method of manufacturing an ornament inlaid with mother-of-pearl, which makes the ornament inlaid with mother-of-pearl look more beautiful by harmoniously forming the ornament inlaid with mother-of-pearl on a corresponding surface. The method includes: applying an acrylic polymer onto a surface to be inlaid with mother-of-pearl to enable subsequent painting to be smoothly performed; painting the surface applied with the acrylic polymer with colors; drawing a picture on the surface painted with the colors; adding and boiling each of the mother-of-pearl and salt in water having a dyeing color dissolved therein for each color, and bonding the mother-of-pearl dyed with each color onto a corresponding portion of the surface of the picture by using an adhesive, followed by drying; and applying paint onto the entire surface, followed by drying.

6 Claims, 1 Drawing Sheet

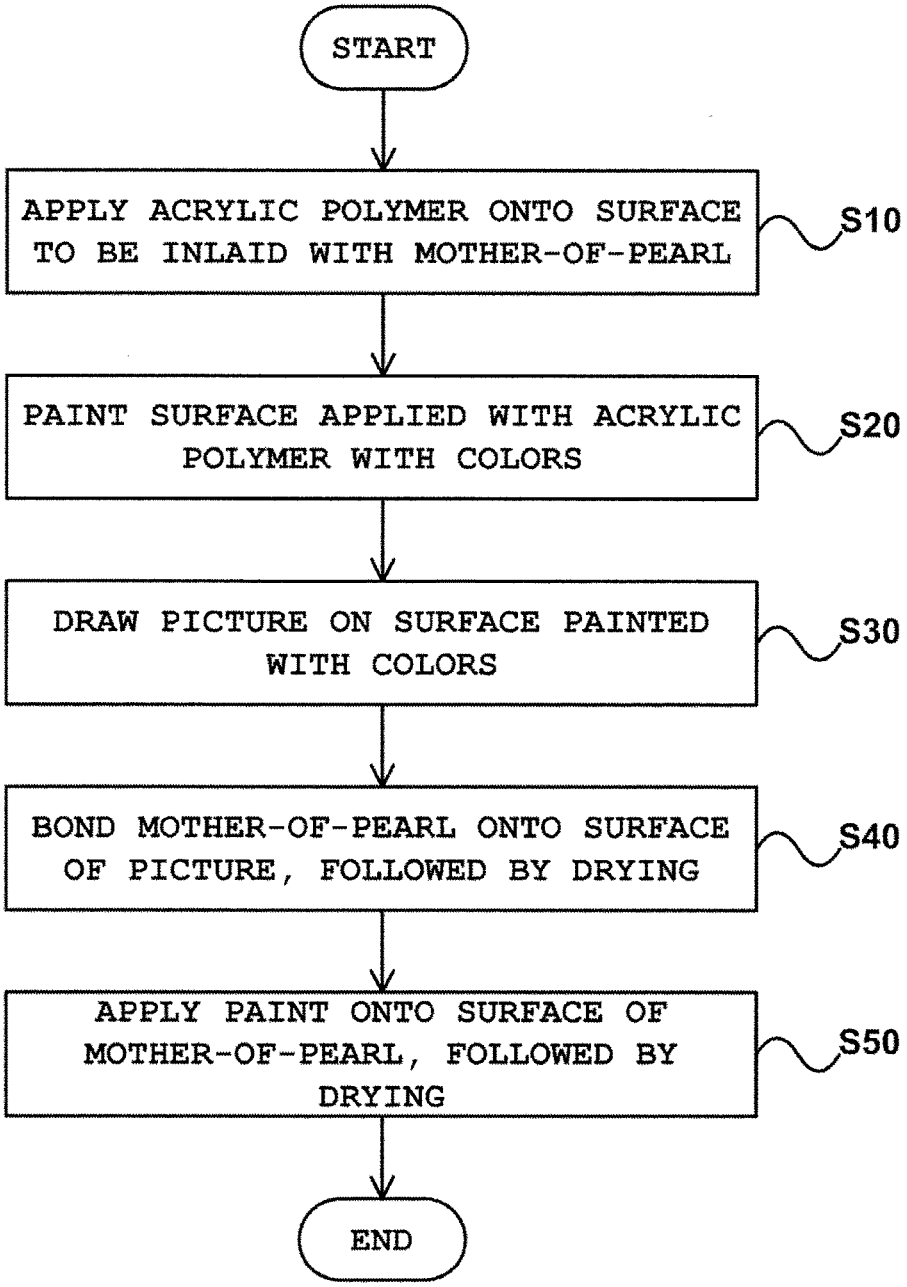
START
APPLY ACRYLIC POLYMER ONTO SURFACE TO BE INLAID WITH MOTHER-OF-PEARL
S10
PAINT SURFACE APPLIED WITH ACRYLIC POLYMER WITH COLORS
S20
DRAW PICTURE ON SURFACE PAINTED WITH COLORS
S30
BOND MOTHER-OF-PEARL ONTO SURFACE OF PICTURE, FOLLOWED BY DRYING
S40
APPLY PAINT ONTO SURFACE OF MOTHER-OF-PEARL, FOLLOWED BY DRYING
S50
END

METHOD OF MANUFACTURING ORNAMENT INLAID WITH MOTHER-OF-PEARL

TECHNICAL FIELD

The present invention relates to a method of manufacturing an ornament inlaid with mother-of-pearl.

BACKGROUND ART

In Korean Patent Application Laid-Open No. 10-2004-0023144 (Laid-Open Date: Mar. 18, 2004) entitled "Decorating Member using Mother-of-Pearl and Manufacturing Method and Using Method thereof" related to the present invention, the decorating member is a decorating member for nail art or a decorating member for decorating an appearance of a mobile phone, and is characterized in that the decorating member includes mother-of-pearl having several natural colors, a plurality of elongated grooves is formed in the decorating member in a width direction thereof so that the decorating member is in close contact with a surface of an object to be attached with the decorating member at the time of attaching the decorating member, and the decorating member is integrated with the mother-of-pearl.

However, according to the related art, even though the mother-of-pearl used in the decorating member has several natural colors and is integrated with the decorating member, there is a limitation in harmoniously forming an ornament inlaid with mother-of-pearl.

SUMMARY OF THE INVENTION

The present invention has been made in an effort to provide a method of manufacturing an ornament inlaid with mother-of-pearl, which harmoniously forms the ornament inlaid with mother-of-pearl on a corresponding surface by applying an acrylic polymer onto a surface to be inlaid with mother-of-pearl, painting the surface applied with the acrylic polymer with colors, drawing a picture on the surface painted with the colors, adding and boiling each of the mother-of-pearl and salt in water having a dyeing color dissolved therein for each color, bonding each mother-of-pearl dyed with each color onto the corresponding portion of a surface of the picture by using an adhesive, followed by drying, and then applying paint onto the entire surface, followed by drying.

An exemplary embodiment of the present invention provides a method of manufacturing an ornament inlaid with mother-of-pearl, the method including: applying an acrylic polymer onto a surface to be inlaid with mother-of-pearl to enable subsequent painting to be smoothly performed; painting the surface applied with the acrylic polymer with colors; drawing a picture on the surface painted with the colors; adding and boiling each of the mother-of-pearl and salt in water having a dyeing color dissolved therein for each color, and bonding the mother-of-pearl dyed with each color onto a corresponding portion of the surface of the picture by using an adhesive, followed by drying; and applying paint onto the entire surface, followed by drying.

In the painting of the surface applied with the acrylic polymer with colors, the colors may be oil colors or acrylic colors.

In the drawing of the picture on the surface painted with the colors, Korean paper may be attached onto the surface painted with the colors by using glue, and then the picture may be drawn on the surface of the Korean paper.

In the adding and boiling of each of the mother-of-pearl and salt in water having a dyeing color dissolved therein for each color, and the bonding of the mother-of-pearl dyed with each color onto a corresponding portion of the surface of the picture by using an adhesive, followed by drying, the adhesive may be a polyvinyl alcohol resin.

In the applying of the paint onto the entire surface, followed by drying, the drying may be performed under a temperature environment of 75 to 80° F. for 72 hours, and the applying of the paint onto the entire surface, followed by drying may be repeatedly performed three times or four times.

The paint may be paint in which a polymer coating resin and a hardener are mixed at a weight ratio of 1:1.

The present invention has an effect in that the ornament inlaid with mother-of-pearl may be harmoniously formed on the corresponding surface by applying the acrylic polymer to the surface onto be inlaid with mother-of-pearl, painting the surface applied with the acrylic polymer with colors, drawing the picture on the surface painted with the colors, adding and boiling each of the mother-of-pearl and salt in water having a dyeing color dissolved therein for each color, bonding each mother-of-pearl dyed with each color onto the corresponding portion of the surface of the picture by using an adhesive, followed by drying, and then applying paint onto the entire surface, followed by drying, thereby making the ornament inlaid with mother-of-pearl look more beautiful.

BRIEF DESCRIPTION OF THE DRAWINGS

FIG. 1 is a process flowchart illustrating an exemplary embodiment of a method of manufacturing an ornament inlaid with mother-of-pearl according to the present invention for each step.

DETAILED DESCRIPTION

Hereinafter, an exemplary embodiment of the present invention will be described in detail with reference to the accompanying drawings.

FIG. 1 is a process flowchart illustrating an exemplary embodiment of a method of manufacturing an ornament inlaid with mother-of-pearl according to the present invention for each step, in which first, an acrylic polymer is applied on a surface to be inlaid with mother-of-pearl several times to enable subsequent painting to be smoothly performed (S10).

The surface applied with the acrylic polymer is painted with oil colors or acrylic colors (S20).

A picture is drawn on the surface painted with the colors (S30). In step S30, after Korean paper is attached onto the surface painted with the colors by using a special paste having good adhesion, such as glue, the picture may be drawn on a surface of the Korean paper.

Each of the mother-of-pearl and salt is added into water having dyeing colors dissolved therein for each color, followed by boiling, and then each mother-of-pearl dyed with each color is bonded onto a corresponding portion of the surface of the picture by using an adhesive such as a polyvinyl alcohol resin or a special paste, followed by drying (S40). In this way, the salt is added and boiled, so that each mother-of-pearl is satisfactorily dyed with each color. In this case, as necessary, the mother-of-pearl may be partially painted.

Paint is applied onto the entire surface of the mother-of-pearl and dried (S50). In this case, the drying at step S50 may be performed under a temperature environment of 75 to 80° F. for about 72 hours, and the whole operation of step S50 may be repeatedly performed three times or four times. The paint may be paint in which a polymer coating resin and a hardener are mixed at a weight ratio of 1:1, and the hardener may be Envirotex Lite. In this case, since the polymer coating resin and the hardener are mixed at the weight ratio of 1:1, the paint is cured within a proper time, thereby smoothly performing a process. When the paint is prepared, a shiny coating agent, such as lacquer or japan, may be mixed together in addition to the polymer coating resin and the hardener.

The method of manufacturing the ornament inlaid with mother-of-pearl according to the present invention may be applied to a cabinet inlaid with mother-of-pearl and the like.

All artistic living goods may be manufactured by applying "the method of manufacturing the ornament inlaid with mother-of-pearl" according to the present invention.

The present invention has an advantage in that the ornament inlaid with mother-of-pearl may be harmoniously formed on the corresponding surface by applying the acrylic polymer onto the surface to be inlaid with mother-of-pearl, painting the surface applied with the acrylic polymer with colors, drawing the picture on the surface painted with the colors, adding and boiling each of the mother-of-pearl and salt in water having a dyeing color dissolved therein for each color, bonding each mother-of-pearl dyed with each color onto the corresponding portion of the surface of the picture by using an adhesive, followed by drying, and then applying paint onto the entire surface, followed by drying, thereby making the ornament inlaid with mother-of-pearl look more beautiful.

From the foregoing, although the technical spirit of the present invention has been described with reference to the accompanying drawings, the exemplary embodiments of the present invention are described only for purposes of illustration and are not intended to limit the present invention. Furthermore, it is apparent to those skilled in the art that various modifications and changes may be made without departing from the technical spirit of the present invention.

What is claimed is:

1. A method of manufacturing an ornament inlaid with mother-of-pearl, the method comprising:

applying an acrylic polymer onto a surface to be inlaid with mother-of-pearl to enable subsequent painting to be smoothly performed;

painting the surface applied with the acrylic polymer with paints;

drawing a picture on the painted surface;

boiling the mother-of-pearl in water with salt, the mother-of-pearl having a dyeing color dissolved therein, and bonding the mother-of-pearl dyed with the dyeing color onto a surface of the picture by using an adhesive, and drying the bonded mother-of-pearl; and applying additional paints onto the entire surface, followed by drying.

2. The method of claim 1, wherein the acrylic polymer with paints comprises oil paints with colors.

3. The method of claim 1, wherein drawing the picture on the surface further comprises drawing the picture on a surface of Korean paper.

4. The method of claim 1, wherein the adhesive is a polyvinyl alcohol resin.

5. The method of claim 1, wherein applying additional paints onto the entire surface comprises drying the applied additional paints with a temperature environment of 75 to 80° F. for 72 hours.

6. The method of claim 1, wherein the additional paints include a polymer coating resin and a hardener which are mixed at a weight ratio of 1:1.

* * * * *